United States Patent [19]

Boneff

[11] Patent Number: 4,830,342

[45] Date of Patent: May 16, 1989

[54] HIGH PRESSURE SINTERING FURNACE

[75] Inventor: Stoyan Boneff, Bayreuth, Fed. Rep. of Germany

[73] Assignee: Degussa Aktiengesellschaft, Frankfurt, Fed. Rep. of Germany

[21] Appl. No.: 75,467

[22] Filed: Jul. 20, 1987

[30] Foreign Application Priority Data

Jul. 30, 1986 [DE] Fed. Rep. of Germany ..... 3625788

[51] Int. Cl.[4] ..... C21D 9/00

[52] U.S. Cl. ..... 266/252; 266/259; 425/405.2

[58] Field of Search ..... 266/249, 252, 207; 425/77, 405 H

[56] References Cited

U.S. PATENT DOCUMENTS

| | | | |
|---|---|---|---|
| 4,088,258 | 5/1978 | Regalbuto | 228/193 |
| 4,398,702 | 8/1983 | Lueth | 266/208 |
| 4,401,297 | 8/1983 | Doi et al. | 266/252 |
| 4,591,482 | 5/1986 | Nyce | 419/38 |

*Primary Examiner*—Christopher W. Brody

*Attorney, Agent, or Firm*—Beveridge, DeGrandi & Weilacher

[57] ABSTRACT

A high pressure sintering furnace is disclosed for the production of compacts from metal and/or nonmetal powders. By mounting a cooling device between the wall of the high pressure shell and the thermal insulation, relatively thin walls can be used for the high pressure shell. Shorter cooling times are also obtained.

4 Claims, 1 Drawing Sheet

HIGH PRESSURE SINTERING FURNACE

Figure 1:
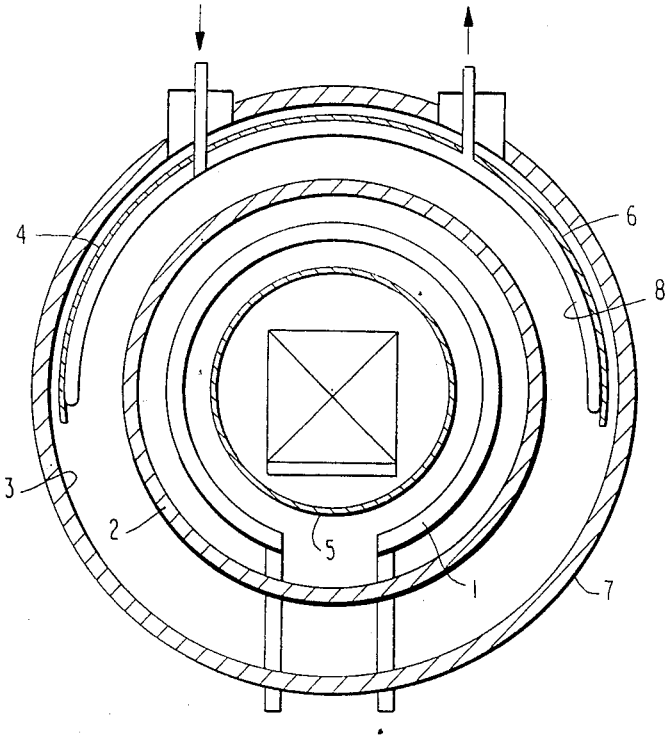
Figure 2:
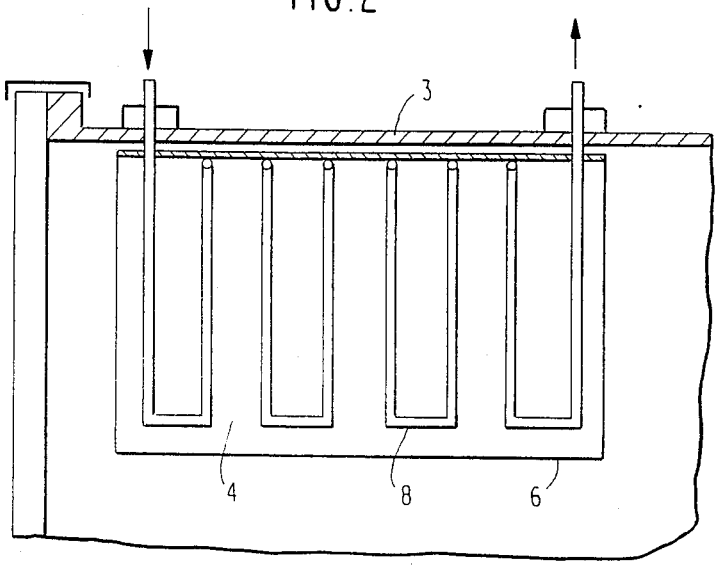

The present invention relates to a high pressure sintering furnace, for the sintering and compacting under pressure of unsintered bodies, known as compacts, formed of metal and/or nonmetal powder. The furnace is comprised of a high pressure metal shell and interior thermal insulation, defining a space within which is mounted a graphite cylindrical furnace chamber to receive the compacts. The furnace chamber is surrounded by heating conductors.

To produce shaped items from metals, ceramics or cermet by sintering metallurgy techniques, furnaces are required in which suitable unsintered bodies or compacts can be sintered and compacted under pressure.

A number of prior developments relate to processes and furnace structures; see U.S. Pat. Nos. 4,398,702 and 4,591,482.

An example of high pressure sintering furnace state of the art is described, for example, in West German DE-GM No. 84 31 211. This furnace is formed of a high pressure-proof metal shell, in the interior of which is arranged thermal insulation made, for example, from graphite felt. Located within the spaces formed by this thermal insulation is the furnace chamber, which is a graphite tube or cylinder, surrounded by heating conductors. In operation, the unsintered bodies are placed inside the furnace chamber where they are then sintered and compacted under pressure with a process gas.

This known furnace design has the disadvantage that a very large amount of heat energy is transferred together with the process gas from the heating conductors through the non-gastight insulation to the wall of the high pressure shell. As a result, the wall of the high pressure shell heats up so that, for reasons of mechanical stability, it must be constructed with fairly thick metal. However, this in turn makes heat removal through the shell wall difficult and also leads to long furnace cooling times.

Therefore, it was the object of the present invention to provide a high pressure sintering furnace for the sintering and compacting under pressure of unsintered bodies and compacts from metal and/or nonmetal powders, comprising a high pressure shell having a layer of thermal insulation in the interior thereof and defining an interior space within which is located a graphite cylinder surrounded by heating conductors.

In this device of the present invention, the shell wall is subjected to the least possible temperature load, thus making possible the construction of the high pressure furnace with relatively thin shell walls and a shorter cooling time. The invention therefore enables shortening the working cycle.

In attaining this and other objects of the invention, one feature of the present invention resides in the installation of a cooling device between the thermal insulation and the high pressure shell on the inside of the furnace.

In a more preferred aspect o the present invention, the cooling device is mounted only in the upper portion of the interior of the high pressure shell in a semi-circular configuration. Furthermore, it is advantageous to fabricate the cooling device from a metal plate adapted to the curvature of the high pressure shell, and moreover, to provide the metal plate with a water cooling device. The metal plate also can be provided, on the side facing the heating conductors, with a layer of thermal insulation, e.g., graphite felt, in order to limit the cooling effect.

It is also advantageous to fabricate the thermal insulation from a plurality of alternating layers of graphite felt and gastight graphite film, so that the flow of process gas from the furnace chamber t the shell wall is largely prevented or retarded. The details of the composite of graphite film and graphite felt are set forth in copending application Ser. No. 075,472 filed July 20, 1987.

The cooling device, which must be formed from a heat conducting metallic material, is installed directly ahead of the inside of the shell wall; i.e. facing the interior of the furnace. Preferably, the cooling device is located only in the upper portion of the inside of the high pressure shell. This cooling device is dimensioned so that a large part of the heat generated externally of the thermal insulation is absorbed and removed by the cooling medium. As a result, the thermal load on the wall of the high pressure shell is relieved, so that only relatively thin walls are necessary for mechanical stability. The improved heat transmission through the thinner wall, in combination with the cooling device, results in a shorter furnace cooling time and thereby in a shortening of the individual working cycles.

Because of the cooling of the process gas, preferably in the upper portion of the high pressure shell, a relatively intensive circulation of the gas occurs in the space between the thermal insulation and the wall of the high pressure shell. This circulation process leads to relatively small temperature differentials between the upper (furnace top) and lower (furnace base) portion of the high pressure shell. This small differential minimizes the thermal stresses on the wall of the high pressure shell, which, in the absence of a cooling device, are caused by the rising hot process gas which heats the furnace top much more intensively than the furnace base.

The invention is illustrated by the accompanying drawings, wherein:

FIG. I is a schematic representation of a high pressure sintering furnace of the invention shown in cross section, and FIG. II is a schematic representation of the cooling device of the invention in a longitudinal section.

Described in further detail, the present invention shown in FIG. I pertains to a high pressure metal shell (7) made of steel or cast iron which has located therein a layer of thermal insulation (2), normally of graphite felt. The layer of thermal insulation can be a single layer, or preferably, a composite of a plurality of layers formed of graphite film and graphite felt in alternating arrangement. The thickness of the insulation layer is conventional and one of ordinary design. The working chamber or furnace chamber of the high pressure sintering furnace is formed of a graphite cylinder or tube (5), which is surrounded by one or more heating conductors 91). Inside the graphite cylinder (5), there is a space provided for the charge of material to be sintered, shown symbolically in FIG. I by the square shape with diagonal lines. The heating conductors or elements (1) are of standard design and well known in the art. The layer of thermal insulation (2) typically is arranged to surround the heating elements and therefore is located in the space between the heating elements and the inside of the shell.

In the upper portion of the interior of the high pressure shell (7), between the inside shell wall (3) and the thermal insulation (2), is mounted the cooling device (4) of the invention.

As shown in further detail in FIG. II, the cooling device is formed of a metal plate, which is adapted to the curvature of the inside of the shell (3) and is provided with a water cooling device (6) in the form of a serpentine tube (8).

The tube (8) is continuous one which has a cold water inlet at one end and an outlet at the other end as shown. The tube is typically welded to the semicircumferential metal plate and is oriented on the underside of the plate as shown in the FIGS. I and II. The plate (6) is spaced apart from the inside wall (3) of shell (7) but is near to the wall (3). The plate when viewed in cross section as in FIG. I extends for a major portion of the top half of the wall (3). In longitudinal section shown in FIG. II, the plate extends for at least half the depth of the furnace, most preferably along substantially the entire useable inside space of the furnace. The exact dimensions of the plate are not narrowly critical and can extend over a wide range.

What is claimed is:

1. A high pressure sintering furnace, for the sintering and compacting under pressure of unsintered bodies from metal and/or nonmetal powders, comprising a high pressure shell, thermal insulation located within said shell defining a space within which is a graphite cylinder, heating means for said furnace and cooling means (4) positioned between the thermal insulation (2) and the high pressure shell (7) and wherein the cooling means is comprised of a metal plate adapted to the curvature of the high pressure shell and wherein the cooling means is positioned only in the upper portion on the inside of the high pressure shell.

2. The high pressure sintering furnace according to claim 1, wherein the metal plate is provided with water cooling means (8).

3. The high pressure sintering furnace according to claim 1, wherein the metal plate is provided on the heating conductor side with a layer of thermal insulation.

4. The high pressure sintering furnace according to claim 1, wherein the thermal insulation (2) comprises a plurality of alternating layers of graphite felt and gas-tight graphite film.

* * * * *